US011525446B2

(12) United States Patent
Hu et al.

(10) Patent No.: US 11,525,446 B2
(45) Date of Patent: Dec. 13, 2022

(54) COMPRESSOR AND AIR CONDITIONER

(71) Applicant: GREEN REFRIGERATION EQUIPMENT ENGINEERING RESEARCH CENTER OF ZHUHAI GREE CO., LTD., Guangdong (CN)

(72) Inventors: Yanjun Hu, Guangdong (CN); Hui Huang, Guangdong (CN); Yusheng Hu, Guangdong (CN); Huijun Wei, Guangdong (CN); Ouxiang Yang, Guangdong (CN); Peizhen Que, Guangdong (CN); Yuanbin Zhai, Guangdong (CN); Liu Xiang, Guangdong (CN); Wang Miao, Guangdong (CN)

(73) Assignee: GREEN REFRIGERATION EQUIPMENT ENGINEERING RESEARCH CENTER OF ZHUHAI GREE CO., LTD., Guangdong (CN)

( * ) Notice: Subject to any disclaimer, the term of this patent is extended or adjusted under 35 U.S.C. 154(b) by 184 days.

(21) Appl. No.: 16/633,578

(22) PCT Filed: May 30, 2018

(86) PCT No.: PCT/CN2018/089017
§ 371 (c)(1),
(2) Date: Jan. 23, 2020

(87) PCT Pub. No.: WO2019/109609
PCT Pub. Date: Jun. 13, 2019

(65) Prior Publication Data

US 2020/0291948 A1 Sep. 17, 2020

(30) Foreign Application Priority Data

Dec. 6, 2017 (CN) ..... 201711277102.8

(51) Int. Cl.
*F04C 28/20* (2006.01)
*F04C 18/356* (2006.01)
(Continued)

(52) U.S. Cl.
CPC ..... *F04C 28/20* (2013.01); *F04C 18/356* (2013.01); *F04C 23/001* (2013.01); *F04C 14/20* (2013.01); *F04C 28/26* (2013.01); *F04C 29/12* (2013.01)

(58) Field of Classification Search
CPC ..... F04C 28/18; F04C 28/20; F04C 18/356; F04C 23/001; F04C 14/20; F04C 28/26;
(Continued)

(56) References Cited

U.S. PATENT DOCUMENTS 5,630,318 A * 5/1997 Folsom ..... F04C 14/20 60/487
2017/0022988 A1* 1/2017 Huang ..... F04C 23/00
2017/0314560 A1* 11/2017 Liang ..... F04C 23/00

* cited by examiner

*Primary Examiner* — Kenneth J Hansen
*Assistant Examiner* — David N Brandt
(74) *Attorney, Agent, or Firm* — J. Miguel Hernandez; James R. Gourley; Carstens, Allen & Gourley, LLP

(57) ABSTRACT

A compressor and an air conditioner are provided. The compressor includes a main shaft, a first cylinder and a second cylinder. The main shaft sequentially passes through the first cylinder and the second cylinder and can rotate therein, to compress refrigerant entering the first cylinder and the second cylinder. The second cylinder has an inner cavity capable of receiving the main shaft. A volume variation control cavity in communication with the inner cavity is provided in a side wall of the inner cavity, and a sliding vane is provided inside the volume variation control cavity. The volume variation control cavity can be selectively connected to a gas inlet and a gas outlet of the compressor, to change gas pressure in the volume variation control cavity, and drive
(Continued)

the sliding vane to abut against or be separated from the main shaft by the gas pressure in the volume variation control cavity.

20 Claims, 5 Drawing Sheets

(51) Int. Cl.
*F04C 23/00* (2006.01)
*F04C 14/20* (2006.01)
*F04C 28/26* (2006.01)
*F04C 29/12* (2006.01)

(58) Field of Classification Search
CPC ..... F04C 14/18; F04C 28/24; F04C 29/12; F25B 31/02
See application file for complete search history.

COMPRESSOR AND AIR CONDITIONER

CROSS-REFERENCE TO RELATED APPLICATION

This application is a U.S. National Stage of International Application No. PCT/CN2018/089017, filed on May 30, 2018 and published as WO 2019/109609 on Jun. 13, 2019, which claims priority to Chinese Patent Application No. 201711277102.8, filed with the Chinese Patent Office on Dec. 6, 2017, the contents of which are hereby incorporated by reference in their entireties.

TECHNICAL FIELD

The present disclosure relates to the technical field of air conditioning, and in particular, to a compressor and an air conditioner.

BACKGROUND

Along with the continuous progress of science and technology and the improvement of people's living standards, the air conditioner has become one of the most important household appliances in people's daily life.

In the air-conditioning system, in order to reach the room temperature set by consumers, the cooling capacity is adjusted by a frequency convertible compressor, namely, by controlling the speed of the compressor, to achieve the purpose of controlling the room temperature precisely. However, limited by the minimum speed of the compressor, the minimum cooling capacity of the frequency convertible compressor is still too large under certain conditions.

SUMMARY

The main objective of the present disclosure is to provide a compressor and an air conditioner, which can reduce the minimum output capacity of the compressor through volume variation, thereby providing a more precise temperature control, and reducing power consumption to achieve the purpose of energy conservation.

The present disclosure provides a compressor, including a main shaft, a first cylinder and a second cylinder;

wherein, the main shaft is configured to sequentially pass through the first cylinder and the second cylinder, and configured to be rotatable in the first cylinder and the second cylinder, so as to compress the refrigerant entering the first cylinder and the second cylinder;

the second cylinder has an inner cavity capable of receiving the main shaft; a volume variation control cavity in communication with the inner cavity is provided in a side wall of the inner cavity, a sliding vane is provided in the volume variation control cavity; the volume variation control cavity is configured to be selectively connected to a gas inlet and a gas outlet of the compressor, so as to change gas pressure in the volume variation control cavity, and drive the sliding vane to abut against or be separated from the main shaft by the gas pressure in the volume variation control cavity.

In an embodiment, the compressor includes a cover plate and a regulating component;

the cover plate is provided with a volume variation channel, a high-pressure channel and a low-pressure channel; the volume variation channel is in communication with the volume variation control cavity; the high-pressure channel is in communication with the gas outlet; and the low-pressure channel is in communication with the gas inlet;

the regulating component is configured to switch between a first position where the volume variation channel is connected to the high-pressure channel, and a second position where the volume variation channel is connected to the low-pressure channel, so as to control pressure of gas passing through the volume variation channel and entering the volume variation control cavity.

In an embodiment, the compressor further includes a driving device;

wherein, the driving device is connected to the regulating component, so as to drive the regulating component to switch between the first position and the second position.

In an embodiment, the cover plate has a first connecting end surface; one end of the volume variation channel is connected with the volume variation control cavity, and another end forms a volume variation connection port in the first connecting end surface; one end of the high-pressure channel is connected with the gas outlet, and another end forms a high-pressure connection port in the first connecting end surface; one end of the low-pressure channel is connected with the gas inlet, and another end forms a low-pressure connection port in the first connecting end surface;

the regulating component is rotatably provided on the first connecting end surface, so as to switch between the first position and the second position on the first connecting end surface; the regulating component is provided with a communicating slot; when the regulating component is located at the first position, both the high-pressure connection port and the volume variation connection port face the communicating slot, so that the high-pressure channel is connected to the volume variation channel through the communicating slot; when the regulating component is located at the second position, both the low-pressure connection port and the volume variation connection port face the communication slot, so that the low-pressure channel is connected to the volume variation channel through the communicating slot.

In an embodiment, the compressor further includes a pressing plate;

wherein, a first receiving groove is provided on the first connecting end surface; the volume variation connection port, the high-pressure connection port and the low-pressure connection port are all located in a bottom wall of the first receiving groove; the regulating component is provided in the first receiving groove; and the pressing plate covers the first receiving groove[[,]] to confine the regulating component inside the first receiving groove.

In an embodiment, the cover plate includes a first cover plate and a second cover plate which are stacked together; a surface of the second cover plate, which is away from the first cover plate, is the first connecting end surface;

the high-pressure channel includes a high-pressure circulating slot provided in the first cover plate and a high-pressure through hole provided in the second cover plate; the high-pressure through hole forms the high-pressure connection port in the first connecting end surface;

the low-pressure channel includes a low-pressure circulating slot provided in the first cover plate and a low-pressure through hole provided in the second cover plate; the low-pressure through hole forms the low-pressure connection port in the first connecting end surface.

In an embodiment, an axis of the high-pressure circulating slot is parallel to the first connecting end surface, and an axis of the high-pressure through hole is perpendicular to the first connecting end surface;

an axis of the low-pressure circulating slot is parallel to the first connecting end surface, and an axis of the low-pressure through hole is perpendicular to the first connecting end surface.

In an embodiment, the compressor further includes a bearing;

wherein, the second cylinder has a second connecting end surface; the volume variation control cavity forms a port in the second connecting end surface; the bearing abuts against the second connecting end surface; a second receiving groove is provided on the bearing at a position corresponding to the port;

a fixing element is provided in the second receiving groove, and pressure variations inside the volume variation control cavity make the fixing element extend into or exit from the volume variation control cavity; when the fixing element extends into the volume variation control cavity, the fixing element is connected to the sliding vane, so as to fix the sliding vane inside the volume variation control cavity.

In an embodiment, the fixing element is provided with a fitting protrusion, and the sliding vane is provided with a locking groove;

when the fixing element extends into the volume variation control cavity, the fitting protrusion is snapped into the locking groove.

In an embodiment, the compressor further includes a spring element;

the fixing element is connected to the inner wall of the second receiving groove through the spring element; when the pressure in the volume variation control cavity becomes lower, the spring element, under its own resilient force, drives the fixing element to extend into the volume variation control cavity.

In another aspect, the present disclosure provides an air conditioner, including a compressor constituted by any combination of the above technical features.

The compressor provided by the present disclosure adopts the volume variation control cavity which can be selectively connected to a gas inlet and a gas outlet of the compressor, so as to change the gas pressure in the volume variation control cavity, and drive the sliding vane to abut against or be separated from the main shaft by the gas pressure in the volume variation control cavity, which can reduce its minimum output capacity through volume variation, thereby providing a more precise temperature control, and reducing the power consumption to achieve the purpose of energy conservation.

BRIEF DESCRIPTION OF DRAWINGS

The accompanying drawings attached to the description form a part of the disclosure and are intended to provide a further understanding of the present disclosure. The illustrative embodiments of the present disclosure and the description thereof are used for explanations of the present disclosure, but are not intended to inappropriately limit the present disclosure. In the accompanying drawings.

Figure 1:
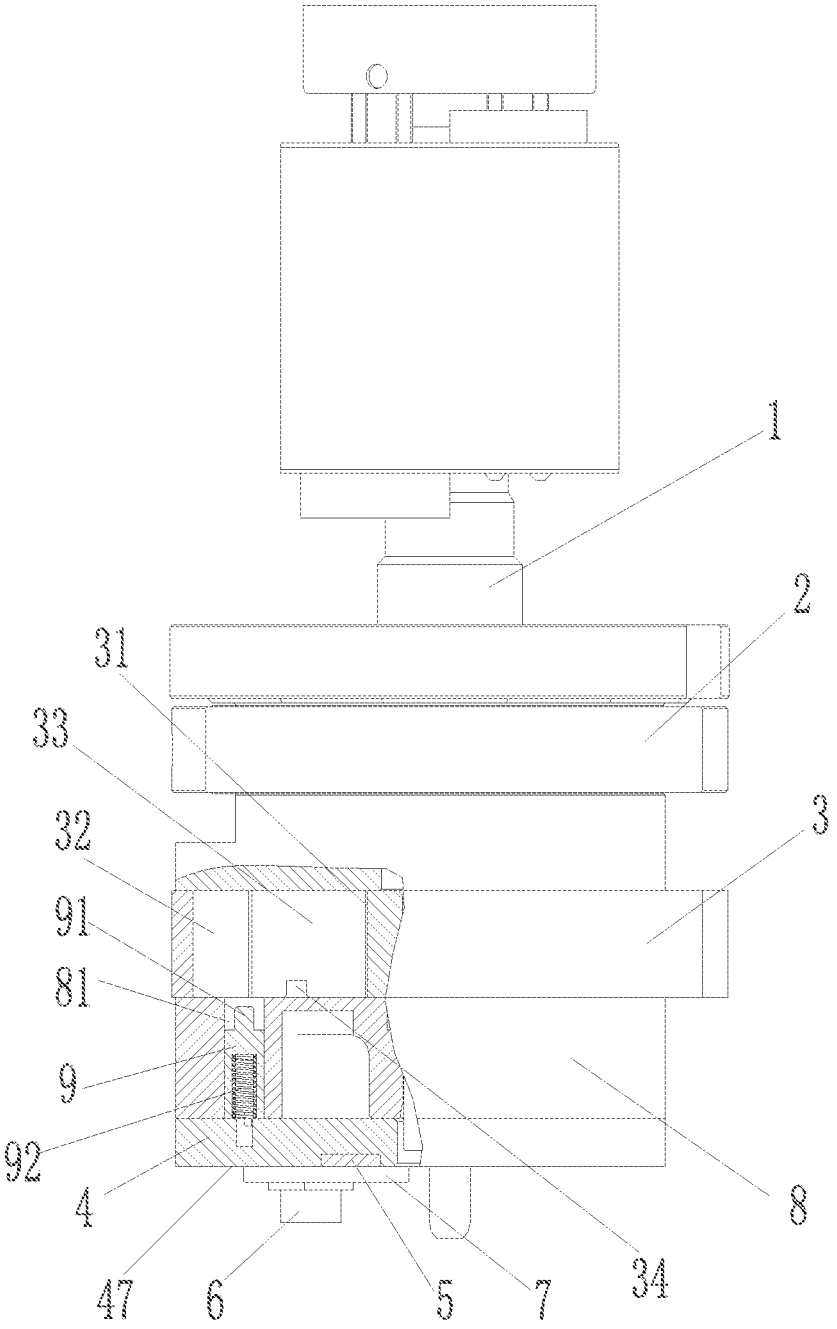
FIG. 1 is a structural schematic diagram of a compressor according to an embodiment of the present disclosure.

in the drawings: 1. main shaft; 2. first cylinder; 3. second cylinder: 31. inner cavity; 32. volume variation control cavity; 33. sliding vane; 34. locking groove; 4. cover plate; 41. volume variation channel; 42. high-pressure channel; 421. high-pressure circulating slot; 422. high-pressure through hole; 43. low-pressure channel; 431. low-pressure circulating slot; 432. low-pressure through hole; 44. first receiving groove; 45. first cover plate; 46. second cover plate; 47. first connecting end surface; 5. regulating component; 51. communicating slot; 6. driving device; 7. pressing plate; 8. bearing; 81. second receiving groove; 9. fixing element: 91. fitting protrusion; 92. spring element.

DETAILED DESCRIPTION OF DISCLOSED EMBODIMENTS

It should be noted that the embodiments in the present disclosure and the features in the embodiments can be combined with each other if no conflict occurs. The disclosure will be described in detail below with reference to the accompanying drawings in combination with the embodiments.

It should be noted that terms used herein are only for the purpose of describing specific embodiments and not intended to limit the exemplary embodiments of the disclosure. The singular of a term used herein is intended to include the plural of the term unless the context otherwise specifies. In addition, it should also be appreciated that when terms "include" and/or "comprise" are used in the description, they indicate the presence of features, steps, operations, devices, components and/or their combination.

It should be noted that the terms "first", "second", and the like in the description, claims and drawings of the present disclosure are used to distinguish similar objects, and are not necessarily used to describe a specific order or sequence. It should be appreciated that such terms can be interchangeable if appropriate, so that the embodiments of the disclosure described herein can be implemented, for example, in an order other than those illustrated or described herein. In addition, the terms "comprise", "have" and any variations thereof, are intended to cover a non-exclusive inclusion, for example, a process, a method, a system, a product, or a device that includes a series of steps or units, which is not necessarily limited to those steps or units explicitly listed, but can include other steps or units that are not explicitly listed or inherent to such a process, a method, a product or a device.

For convenience of description, spatially relative terms such as "above", "over", "on a surface of", "upper", etc., may be used herein to describe the spatial position relationships between one device or feature and other devices or features as shown in the drawings. It should be appreciated that the spatially relative term is intended to include different directions during using or operating the device other than the directions described in the drawings. For example, if the device in the drawings is inverted, the device is described as the device "above other devices or structures" or "on other devices or structures" will be positioned "below other devices or structures" or "under other devices or structures". Thus, the exemplary term "above" can include both "above" and "under". The device can also be positioned in other different ways (rotating 90 degrees or at other orientations), and the corresponding description of the space used herein is interpreted accordingly.

Now, the exemplary embodiments of the present disclosure will be further described in detail with reference to the accompanying drawings. However, these exemplary embodiments can be implemented in many different forms and should not be construed as only limited to the embodiments described herein. It should be appreciated that the embodiments are provided to make the present disclosure disclosed thoroughly and completely, and to fully convey the concepts of the exemplary embodiments to those skilled in the art. In the accompanying drawings, for the sake of clarity, the thicknesses of layers and regions may be enlarged, and a same reference sign is used to indicate a same device, thus the description thereof will be omitted.

In order to make the objectives, the technical solutions and the advantages of the present disclosure more apparent and better understood, the technical solutions of the present disclosure will be described clearly and completely with reference to the accompanying drawings and embodiments of the present disclosure. Apparently, the described embodiments below are only a part of the embodiments of the present disclosure, but not all embodiments of the present disclosure. All other embodiments obtained by those skilled in the art based on the embodiments of the present disclosure without creative work are within the protection scope of the present disclosure.

As shown in FIG. 1, a compressor includes a main shaft 1, a first cylinder 2 and a second cylinder 3. The main shaft 1 is configured to sequentially pass through the first cylinder 2 and the second cylinder 3, and configured to rotate in the first cylinder 2 and the second cylinder 3, compressing the refrigerant entering the first cylinder 2 and the second cylinder 3. The second cylinder 3 has an inner cavity 31 capable of receiving the main shaft 1, and a volume variation control cavity 32 in communication with the inner cavity 31 is provided in a side wall of the inner cavity 31. A sliding vane 33 is provided in the volume variation control cavity 32. Furthermore, the volume variation control cavity 32 can be selectively connected to the gas inlet 30 and the gas outlet 20 of the compressor, so as to change gas pressure in the volume variation control cavity 32, and drive the sliding vane 33 to abut against or be separated from the main shaft 1 by the gas pressure in the volume variation control cavity 32.

In practice, when the volume variation control cavity 32 is in communication with the gas outlet 20, the high-pressure refrigerant discharged from the gas outlet 20 can enter the volume variation control cavity 32 and form higher gas pressure to drive the sliding vane 33 to move from the volume variation control cavity 32 into the inner cavity 31 to abut against the main shaft 1 (specifically, it can be a roller arranged on the main shaft 1), so that the refrigerant entering the second cylinder 3 is compressed by the rotating main shaft 1 cooperating with the sliding vane 33. At this time, the compressor compresses the refrigerant via the first cylinder 2 and the second cylinder 3 simultaneously, and the output capacity of the compressor is in a higher state. When the volume variation control cavity 32 is in communication with the gas inlet 30, the low-pressure refrigerant discharged from the gas inlet 30 can enter the volume variation control cavity 32. At this time, the gas pressure in the volume variation control cavity 32 is the same as the gas pressure in the inner cavity 31, that is, the pressures at two ends of the sliding vane 33 are identical. The sliding vane 33 cannot move from the volume variation control cavity 32 to the inner cavity 31 to abut against the main shaft 1, thus, the refrigerant entering the second cylinder 3 cannot be compressed by the main shaft 1 cooperating with the sliding vane 33. At this time, only the refrigerant in the first cylinder 2 of the compressor is compressed, and the output capacity of the compressor is in a lower state. Therefore, the compressor in this embedment can reduce its minimum output capacity through volume variation, thereby controlling the temperature more precisely. Moreover, compared with the compressor adjusting the cooling capacity by adjusting the speed of the compressor in the existing technology, the compressor of this embodiment can also reduce power consumption, thereby achieving the purpose of energy conservation.

Figure 2:
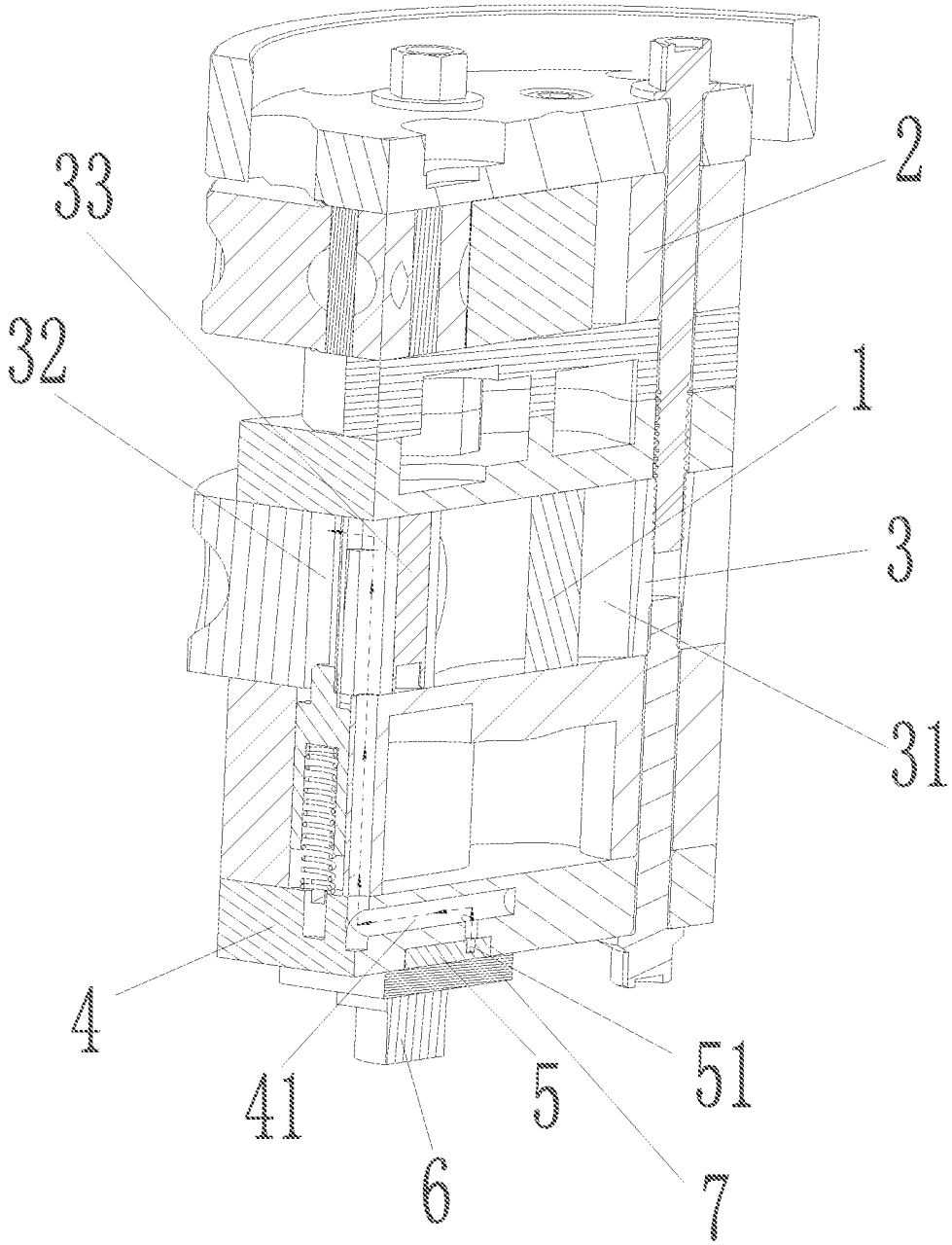
FIG. 2 is a schematic diagram illustrating a volume variation channel provided in a cover plate in FIG. 1.
Figure 3:
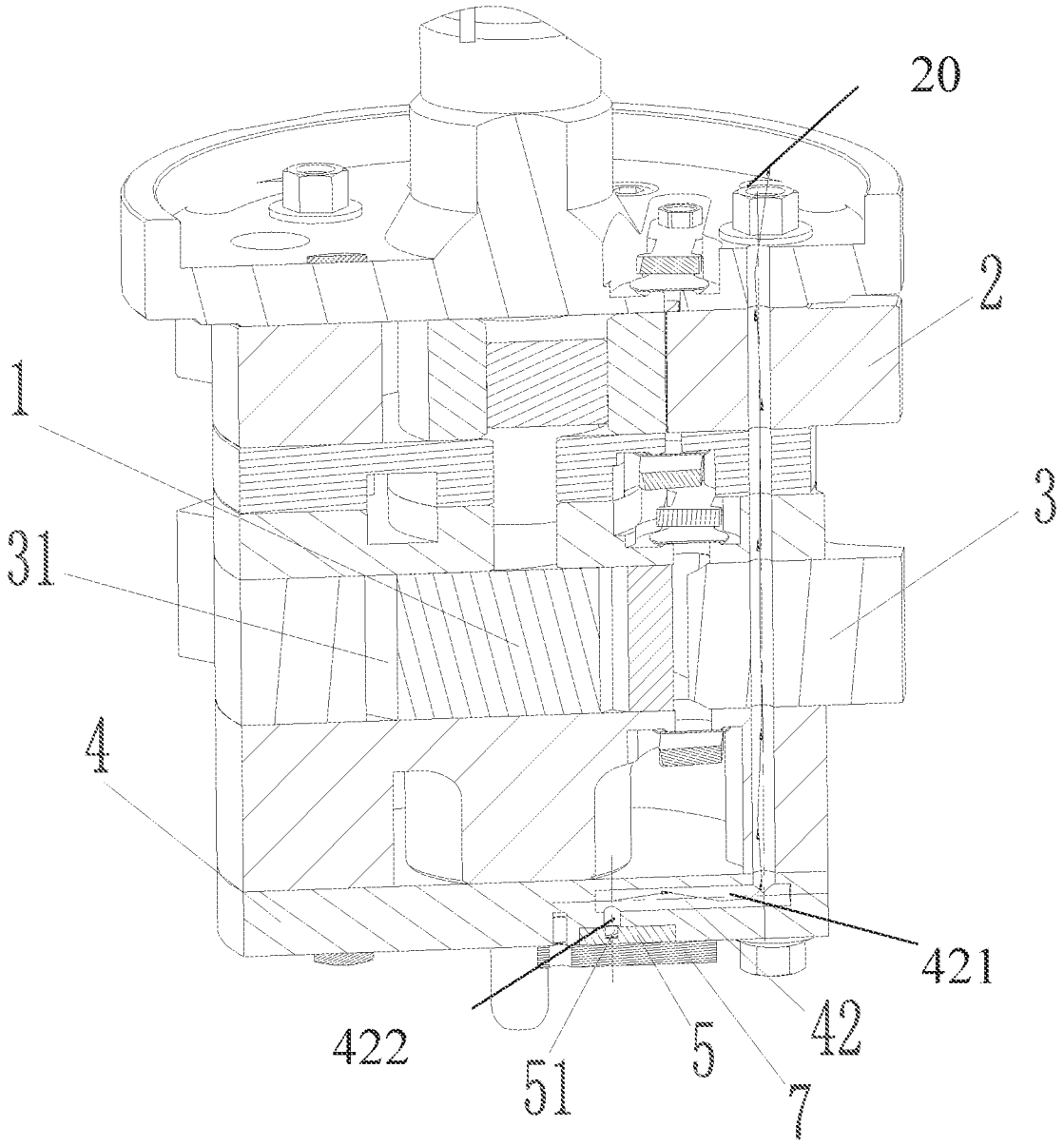
FIG. 3 is a schematic diagram illustrating a high-pressure channel provided in the cover plate in FIG. 1.
Figure 4:
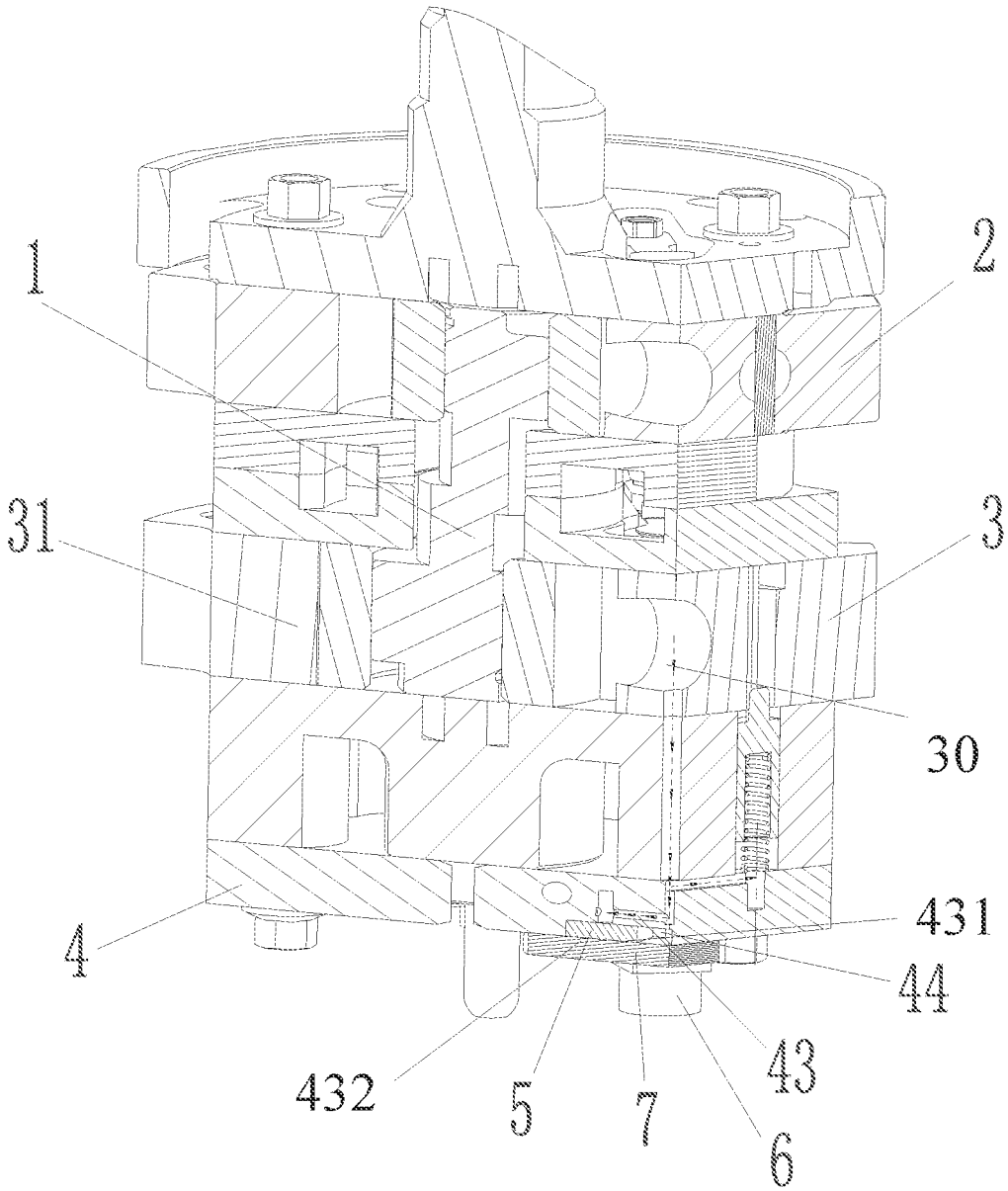
FIG. 4 is a schematic diagram illustrating a low-pressure channel provided in the cover plate in FIG. 1.

The selective communication between the volume variation control cavity 32 and the gas inlet 30 and the gas outlet 20 of the compressor is shown in FIGS. 2, 3 and 4. The compressor includes a cover plate 4 and a regulating component 5. The cover plate 4 is provided with a volume variation channel 41, a high-pressure channel 42 and a low-pressure channel 43. The volume variation channel 41 is in communication with the volume variation control cavity 32; the high-pressure channel 42 is in communication with the gas outlet 20: and the low-pressure channel 43 is in communication with the gas inlet 30.

The regulating component 5 can switch between a first position where the volume variation channel 41 is connected to the high-pressure channel 42, and a second position where the volume variation channel 41 is connected to the low-pressure channel 43, to control the pressure of the gas passing through the volume variation channel 41 and entering the volume variation control cavity 32. Further, as shown in the figure, a driving device 6 (preferably a motor) is further provided. The driving device 6 is connected to the regulating component 5, so as to drive the regulating component 5 to switch between the first position and the second position.

Figure 5:
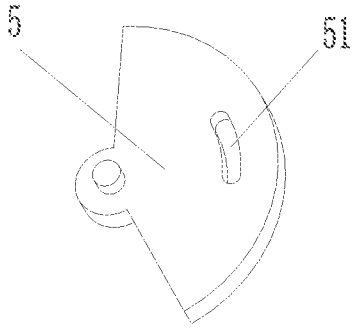
FIG. 5 is a schematic diagram of a regulating component in FIG. 1.

Specifically, the cover plate 4 has a first connecting end surface 47. One end of the volume variation channel 41 is connected with the volume variation control cavity 32, and another end forms a volume variation connection port (not shown in the figure) in the first connecting end surface 47. One end of the high-pressure channel 42 is connected with the gas outlet 20, and another end forms a high-pressure connection port (not shown in the figure) in the first connecting end surface 47. One end of the low-pressure channel 43 is connected with the gas inlet 30, and another end forms a low-pressure connection port (not shown in the figure) in the first connecting end surface 47. The regulating component 5 is rotatably provided on the first connecting end surface 47, so as to switch between the first position and the second position on the first connecting end surface 47. As shown in FIG. 5, the regulating component 5 is provided with a communicating slot 51. When the regulating component 5 is located at the first position, both the high-pressure connection port and the volume variation connection port face the communicating slot 51, so that the high-pressure channel 42 is in communication with the volume variation channel 41 through the communicating slot 51. When the regulating component 5 is located at the second position, both the low-pressure connection port and the volume variation connection port correspond to the communication slot 51, so that the low-pressure channel 43 is in communication with the volume variation channel 41 through the communicating slot 51. The regulating component 5 can be made into a sector-shaped structure in a specific implementation, and in this way, the regulating component 5 switches between the first position and the second position by means of rotation, which can decrease the range of movement of the regulating component 5, thereby preventing the regulating component 5 from interfering with other components during the movement to become jammed, and guaranteeing the reliability of the volume variation switching of the compressor.

Further, as shown in FIGS. 1, 2, 3 and 4, a pressing plate 7 is further provided. A first receiving groove 44 is provided on the first connecting end surface. The volume variation connection port, the high-pressure connection port and the low-pressure connection port are all located in the bottom wall of the first receiving groove 44. The regulating component 5 is provided in the first receiving groove 44. The pressing plate 7 covers the first receiving groove 44, to confine the regulating component 5 inside the first receiving groove 44. In this way, the regulating component 5 can be completely confined in the first receiving groove 44, thereby preventing the regulating component 5 from interfering with other components during the movement. Moreover, the regulating component 5 is confined in the first receiving groove 44 by the pressing plate 7, which can further ensure that the pressing plate 7 reliably responds to the volume variation connection port, the high-pressure connection port and the low-pressure connection port, thereby further ensuring the reliability of the volume variation switching of the compressor.

Figure 6:
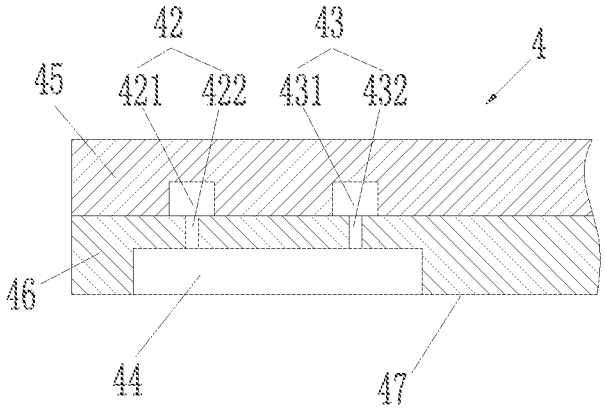
FIG. 6 is a schematic diagram of an alternative structure of the cover plate.

It should be noted that the cover plate 4 can be an integrated structure shown in FIGS. 1, 2, 3 and 4 or an alternative structure shown in FIG. 6. As shown in FIG. 6, the cover plate 4 includes a first cover plate 45 and the second cover plate 46 which are stacked together. A surface of the second cover plate 46, which is away from the first cover plate 45, is the first connecting end surface 47. The high-pressure channel 42 includes a high-pressure circulating slot 421 provided in the first cover plate 45 and a high-pressure through hole 422 provided in the second cover plate 46. The high-pressure through hole 422 forms the high-pressure connection port in the first connecting end surface 47. In this case, the low-pressure channel 43 includes a low-pressure circulating slot 431 provided in the first cover plate 45 and a low-pressure through hole 432 provided in the second cover plate 46. The low-pressure through hole 432 forms the low-pressure connection port in the first connecting end surface 47. Adopting such a structure can make the manufacturing of the high-pressure channel 42 and the low-pressure channel 43 easier and more convenient. In a specific implementation, the axis of the high-pressure circulating slot 421 can be made parallel to the first connecting end surface 47, and the axis of the high-pressure through hole 422 can be made perpendicular to the first connecting end surface. Similarly, the axis of the low-pressure circulating slot 431 can be made parallel to the first connecting end surface 47, and the axis of the low-pressure through hole 432 is perpendicular to the first connecting end surface.

In an embodiment shown in FIG. 1, a bearing 8 is further provided. The second cylinder 3 has a second connecting end surface (not shown in the figure); the volume variation control cavity 32 forms a port in the second connecting end surface; the bearing 8 abuts against the second connecting end surface, and a second receiving groove 81 is provided on the bearing at a position responding to the port. A fixing element 9 is provided in the second receiving groove 81, and pressure variations inside the volume variation control cavity 32 can make the fixing element 9 extend into or exit from the volume variation control cavity 32. When the fixing element 9 extends into the volume variation control cavity 32, the fixing element 9 can be connected to the sliding vane 33, so as to fix the sliding vane 33 inside the volume variation control cavity 32. The connecting mode of the fixing element 9 and a bracket of the sliding vane 33 is shown in FIG. 1. The fixing element is provided with a fitting protrusion 91, and the sliding vane 33 is provided with a locking groove 34; when the fixing element 9 extends into the volume variation control cavity 32, the fitting protrusion 91 can be snapped into the locking groove 34. Specifically, as shown in FIG. 1, a spring element 92 is further provided; the fixing element 9 is connected to the inner wall of the second receiving groove 81 through the spring element 92. When the pressure in volume variation control cavity 32 becomes lower, the spring element 92, under its own resilient force, drives the fixing element 9 to extend into the volume variation control cavity 32.

In practice, when the volume variation control cavity 32 is in communication with the gas outlet 20, the high-pressure gas entering the volume variation control cavity 32 forces the sliding vane 33 to move from the volume variation control cavity 32 into the inner cavity 31 and to abut against the main shaft 1, and simultaneously, drives the fixing element 9 to overcome the resilient force of the spring element 92, so that fixing element 9 cannot extend into the volume variation control cavity 32, that is, the fixing element 9 cannot fix the sliding vane 33. At this time, the main shaft 1, cooperating with the sliding vane 33, compresses the refrigerant entering the second cylinder 3, that is, the second cylinder 3 is in a working state. When the volume variation control cavity 32 is in communication with the gas inlet 30, the gas pressure inside the volume variation control cavity 32 is lower, and the spring element 92, under its own resilient force, drives the fixing element 9 to overcome the gas force in the volume variation control cavity 32, to extend into the volume variation control cavity 32. As described above, at this time, the sliding vane 33 is located inside the volume variation control cavity 32. Therefore, through locking the fitting protrusion 91 in the locking groove 34 of the sliding vane 33, the fixing element 9 can fix the sliding vane 33 inside the volume variation control cavity 32, thereby preventing the sliding vane 33 from moving into the inner cavity 31 and abutting against the main shaft 1 to make the second cylinder 3 enter a working state, thereby ensuring the reliability of the capacity variance.

In order to realize the objective of the present disclosure, the present disclosure provides an air conditioner including a compressor as described in the above embodiments.

The above embodiments of the present disclosure can reduce the minimum output capacity of the compressor through volume variation, thereby providing a more precise temperature control, and reducing the power consumption to achieve the purpose of energy conservation.

In addition to the above description, it also should be noted that "one embodiment", "another embodiment", "an embodiment" and the like in the description refer to that a specific feature, a structure or a characteristic described in combination with the embodiment is included in at least one embodiment generally described in the present disclosure. The same expression in various locations in the specification does not necessarily refer to the same embodiment. Furthermore, when a specific feature, a structure, or a characteristic is described in combination with any embodiments, what is claimed is that other embodiments which are combined to implement such a feature, a structure, or a characteristic are also included in the scope of the present disclosure.

In the above embodiments, the descriptions of the various embodiments have different emphases, and any portions that are not detailed in a certain embodiment can be seen in the related descriptions of other embodiments.

The above descriptions are merely the preferred embodiments of the present disclosure, and are not intended to limit the present disclosure. For those skilled in the art, various modifications and changes can be made for the present disclosure. Any modifications, equivalent substitutions, improvements, etc., made within the spirits and the principles of the present disclosure, are all within the protection scope of the present disclosure.

What is claimed is:

1. A compressor, comprising: a main shaft, a first cylinder and a second cylinder; wherein the main shaft is configured to sequentially pass through the first cylinder and the second cylinder, and configured to be rotatable in the first cylinder and the second cylinder, so as to compress refrigerant entering the first cylinder and the second cylinder; and the second cylinder has an inner cavity capable of receiving the main shaft; a volume variation control cavity in communication with the inner cavity is provided in a side wall of the inner cavity; a sliding vane is provided in the volume variation control cavity; and the volume variation control cavity is configured to be selectively connected to a gas outlet of the compressor, so as to change gas pressure in the volume variation control cavity, and drive the sliding vane to abut against or be separated from the main shaft by the gas pressure in the volume variation control cavity; a cover plate; the cover olate is provided with a volume variation channel, a high-pressure channel and a low-pressure channel.

2. The compressor according to claim, the compressor comprises a regulating component; the volume variation channel is in communication with the volume variation control cavity; the high-pressure channel is in communication with the gas outlet; and the low-pressure channel is in communication with the gas inlet; and the regulating component is configured to switch between a first position where the volume variation channel is connected to the high-pressure channel, and a second position where the volume variation channel is connected to the low-pressure channel, so as to control pressure of gas passing through the volume variation channel and entering the volume variation control cavity.

3. The compressor according to claim 2, further comprising a driving device; wherein:

the driving device is connected to the regulating component, so as to drive the regulating component to switch between the first position and the second position.

4. The compressor according to claim 2, wherein: the cover plate has a first connecting end surface; one end of the volume variation channel is connected with the volume variation control cavity, and another end forms a volume variation connection port in the first connecting end surface; one end of the high-pressure channel is connected with the gas outlet, and another end forms a high-pressure connection port in the first connecting end surface; one end of the low-pressure channel is connected with a gas inlet, and another end forms a low-pressure connection port in the first connecting end surface; and the regulating component is rotatably provided on the first connecting end surface, so as to switch between the first position and the second position on the first connecting end surface; the regulating component is provided with a communicating slot; the compressor is configured so that when the regulating component is located at the first position, both the high pressure connection port and the volume variation connection port face the communicating slot, so that the high-pressure channel is connected to the volume variation channel through the communicating slot; and the compressor is configured so that when the regulating component is located at the second position, both the low-pressure connection port and the volume variation connection port face the communication slot, so that the low-pressure channel is connected to the volume variation channel through the communicating slot.

5. The compressor according to claim 4, further comprising a pressing plate; wherein:

a first receiving groove is provided on the first connecting end surface; the volume variation connection port, the high-pressure connection port and the low-pressure connection port are all located in a bottom wall of the first receiving groove; the regulating component is provided in the first receiving groove; and the pressing plate covers the first receiving groove to confine the regulating component inside the first receiving groove.

6. The compressor according to claim 4, wherein:

the cover plate comprises a first cover plate and a second cover plate which are stacked together; a surface of the second cover plate, which is away from the first cover plate, is the first connecting end surface;

the high-pressure channel comprises a high-pressure circulating slot provided in the first cover plate and a high-pressure through hole provided in the second cover plate; the high-pressure through hole forms the high-pressure connection port in the first connecting end surface; and the low-pressure channel comprises a low-pressure circulating slot provided in the first cover plate and a low-pressure through hole provided in the second cover plate; and the low-pressure through hole forms the low-pressure connection port in the first connecting end surface.

7. The compressor according to claim 6, wherein:

an axis of the high-pressure circulating slot is parallel to the first connecting end surface, and an axis of the high-pressure through hole is perpendicular to the first connecting end surface; and an axis of the low-pressure circulating slot is parallel to the first connecting end surface, and an axis of the low-pressure through hole is perpendicular to the first connecting end surface.

8. The compressor according to claim 1, further comprising a bearing; wherein:

the second cylinder has a second connecting end surface; the volume variation control cavity forms a port in the second connecting end surface; the bearing abuts against the second connecting end surface; a second receiving groove is provided on the bearing at a position corresponding to the port; and a fixing element is provided in the second receiving groove, and pressure variations inside the volume variation control cavity make the fixing element extend into or exit from the volume variation control cavity; and the compressor is configured so that when the fixing element extends into the volume variation control cavity, the fixing element is connected to the sliding vane, so as to fix the sliding vane inside the volume variation control cavity.

9. The compressor according to claim 8, wherein:

the fixing element is provided with a fitting protrusion, and the sliding vane is provided with a locking groove; and the compressor is configured so that when the fixing element extends into the volume variation control cavity, the fitting protrusion is snapped into the locking groove.

10. The compressor according to claim 8, further comprising a spring element; wherein:

the fixing element is connected to an inner wall of the second receiving groove through the spring element; and the compressor is configured so that when the gas pressure in the volume variation control cavity becomes lower, the spring element, under its own resilient force, drives the fixing element to extend into the volume variation control cavity.

11. An air conditioner, comprising the compressor of claim 1.

12. The air conditioner according to claim 11, wherein the compressor comprises a regulating component; the volume variation channel is in communication with the volume variation control cavity; the high-pressure channel is in communication with the gas outlet; and the low-pressure channel is in communication with a gas inlet; and the regulating component is configured to switch between a first position where the volume variation channel is connected to the high-pressure channel, and a second position where the volume variation channel is connected to the low-pressure channel, so as to control pressure of gas passing through the volume variation channel and entering the volume variation control cavity.

13. The air conditioner according to claim 12, wherein:

the compressor further comprises a driving device; and the driving device is connected to the regulating component, so as to drive the regulating component to switch between the first position and the second position.

14. The air conditioner according to claim 12, wherein: the cover plate has a first connecting end surface; one end of the volume variation channel is connected with the volume variation control cavity, and another end forms a volume variation connection port in the first connecting end surface; one end of the high-pressure channel is connected with a gas outlet, and another end forms a high-pressure connection port in the first connecting end surface; one end of the low-pressure channel is connected with the gas inlet, and another end forms a low-pressure connection port in the first connecting end surface; and the regulating component is rotatably provided on the first connecting end surface, so as to switch between the first position and the second position on the first connecting end surface; the regulating component is provided with a communicating slot; the compressor is configured so that when the regulating component is located at the first position, both the high-pressure connection port and the volume variation connection port face the communicating slot, so that the high-pressure channel is connected to the volume variation channel through the communicating slot; and the compressor is configured so that when the regulating component is located at the second position, both the low-pressure connection port and the volume variation connection port face the communication slot, so that the low-pressure channel is connected to the volume variation channel through the communicating slot.

15. The air conditioner according to claim 14, wherein:

the compressor further comprises a pressing plate; and a first receiving groove is provided on the first connecting end surface; the volume variation connection port, the high-pressure connection port and the low-pressure connection port are all located in a bottom wall of the first receiving groove; the regulating component is provided in the first receiving groove; and the pressing plate covers the first receiving groove to confine the regulating component inside the first receiving groove.

16. The air conditioner according to claim 14, wherein:

the cover plate comprises a first cover plate and a second cover plate which are stacked together; a surface of the second cover plate, which is away from the first cover plate, is the first connecting end surface;

the high-pressure channel comprises a high-pressure circulating slot provided in the first cover plate and a high-pressure through hole provided in the second cover plate; the high-pressure through hole forms the high-pressure connection port in the first connecting end surface; and the low-pressure channel comprises a low-pressure circulating slot provided in the first cover plate and a low-pressure through hole provided in the second cover plate; and the low-pressure through hole forms the low-pressure connection port in the first connecting end surface.

17. The air conditioner according to claim 16, wherein:

an axis of the high-pressure circulating slot is parallel to the first connecting end surface, and an axis of the high-pressure through hole is perpendicular to the first connecting end surface; and an axis of the low-pressure circulating slot is parallel to the first connecting end surface, and an axis of the low-pressure through hole is perpendicular to the first connecting end surface.

18. The compressor according to claim 3, wherein, the driving device is a motor.

19. The compressor according to claim 3, wherein, the regulating component is configured to switch between the first position and the second position by means of rotation.

20. The compressor according to claim 4, wherein, the cover plate is an integrated structure.

* * * * *